US010590572B2

(12) United States Patent
Koyabu et al.

(10) Patent No.: US 10,590,572 B2
(45) Date of Patent: Mar. 17, 2020

(54) FOOTWEAR

(71) Applicant: SHIMA SEIKI MFG., LTD., Wakayama-shi, Wakayama (JP)

(72) Inventors: Yoshiharu Koyabu, Wakayama (JP); Yoshinori Shimasaki, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 148 days.

(21) Appl. No.: 15/880,676

(22) Filed: Jan. 26, 2018

(65) Prior Publication Data

US 2018/0146736 A1 May 31, 2018

Related U.S. Application Data

(63) Continuation of application No. PCT/JP2016/072121, filed on Jul. 28, 2016.

(30) Foreign Application Priority Data

Aug. 19, 2015 (JP) ..... 2015-161595

(51) Int. Cl.
*D04B 1/24* (2006.01)
*A43B 9/00* (2006.01)
(Continued)

(52) U.S. Cl.
CPC ..... *D04B 1/24* (2013.01); *A43B 1/04* (2013.01); *A43B 9/00* (2013.01); *A43B 23/0245* (2013.01);
(Continued)

(58) Field of Classification Search
CPC .. D04B 1/10; D04B 1/104; D04B 1/24; A43B 1/04; A43B 23/042
See application file for complete search history.

(56) References Cited

U.S. PATENT DOCUMENTS 7,204,043 B2 * 4/2007 Kilgore ..... A43B 23/042 36/105
8,065,818 B2 * 11/2011 Greene ..... A43B 23/04 36/45
(Continued)

FOREIGN PATENT DOCUMENTS

JP S02-5978 6/1987
JP H1014601 A 1/1998
(Continued)

OTHER PUBLICATIONS

Extended European Search Report cited in 16836948.6 dated Mar. 15, 2019, 8 pages.
(Continued)

*Primary Examiner* — Danny Worrell
(74) *Attorney, Agent, or Firm* — Rothwell, Figg, Ernst & Manbeck, P.C.

(57) ABSTRACT

Provided is footwear that can simplify joining operation and reduce the time of the operation when a knitted fabric is formed into a three-dimensional shape. There is presupposed footwear obtained by forming a knitted fabric knitted with a flat knitting machine into a three-dimensional shape by joining left and right extended ends of a shoe tongue part and both the left and right positions of a sole in a front end portion of a main part. The footwear includes insertion pieces extended outward in a left-right direction from the left and right extended ends of the shoe tongue part, and insertion holes that linearly extend from both the left and right positions of the sole in the front end portion of the main part toward a heel part side, receive the insertion pieces inserted thereinto, and temporarily retain the insertion pieces.

4 Claims, 4 Drawing Sheets

(51) Int. Cl.

| | |
|---|---|
| ***D04B 1/22*** | (2006.01) |
| ***A43B 23/02*** | (2006.01) |
| ***A43B 23/04*** | (2006.01) |
| ***A43B 1/04*** | (2006.01) |

(52) U.S. Cl.
CPC ..... *A43B 23/042* (2013.01); *D04B 1/22* (2013.01); *D10B 2403/0332* (2013.01); *D10B 2501/043* (2013.01)

(56) References Cited

U.S. PATENT DOCUMENTS

| | | | | |
|---|---|---|---|---|
| 9,549,591 | B2 * | 1/2017 | Uchikawa | D04B 1/24 |
| 9,554,618 | B2 * | 1/2017 | Bell | A43B 1/0081 |
| 9,719,198 | B2 * | 8/2017 | Ikenaka | D04B 1/22 |
| 9,936,757 | B2 * | 4/2018 | Podhajny | D04B 1/123 |
| 2006/0032091 | A1 | 2/2006 | Kilgore | |
| 2007/0180730 | A1 | 8/2007 | Greene et al. | |
| 2014/0245633 | A1 | 9/2014 | Podhajny | |
| 2015/0157084 | A1 | 6/2015 | Bell et al. | |
| 2015/0374062 | A1 | 12/2015 | Ikenaka et al. | |
| 2016/0198797 | A1 | 7/2016 | Ikenaka | |
| 2016/0213097 | A1 * | 7/2016 | Uchikawa | D04B 1/24 |
| 2016/0255913 | A1 | 9/2016 | Uchikawa et al. | |

FOREIGN PATENT DOCUMENTS

| | | | |
|---|---|---|---|
| JP | 2000158560 | A | 6/2000 |
| JP | 5166431 | B2 | 3/2012 |
| WO | 2008060928 | A1 | 5/2008 |
| WO | 2014050289 | A1 | 4/2014 |
| WO | 2014129068 | A1 | 8/2014 |
| WO | 2015037540 | A1 | 3/2015 |
| WO | 2015056633 | A1 | 4/2015 |
| WO | 2015115576 | A1 | 8/2015 |

OTHER PUBLICATIONS

Search Report cited in PCT/JP2016/072121 dated Oct. 25, 2016, 2 pages.

* cited by examiner

FOOTWEAR

CROSS REFERENCE TO RELATED APPLICATION

This application is a continuation of PCT/JP2016/072121, filed Jul. 28, 2016, which claims the benefit of Japanese Patent Application No. 2015-161595 filed on Aug. 19, 2015, the disclosures of which are incorporated by reference herein, in their entirety.

BACKGROUND OF THE INVENTION

Field of the Invention

The present invention relates to footwear obtained by forming a knitted fabric knitted with a flat knitting machine including at least a pair of front and rear needle beds into a three-dimensional shape by joining together joint portions needing each other. The present invention more particularly relates to a measure for firmly joining the joint portions together by joining means simply and quickly.

Description of the Related Art

Conventionally, as this kind of footwear, there is known footwear obtained by forming one knitted fabric into a three-dimensional shape by joining joint portions together by joining means such as sewing (see PTL 1).

CITATION LIST

Patent Literature

PTL 1: Japanese Patent No. 5166431

BRIEF SUMMARY OF THE INVENTION

However, regarding the conventional footwear, when the joint portions of the knitted fabric are joined together by the joining means such as sewing, an operator needs to temporarily retain the joined state between the joint portions until joining by the joining means is completed. Hence, it is markedly troublesome work to perform joining operation of joining the joint portions together while the operator temporarily retains the joined state of the joint portions, and also the operation takes time.

In the joining operation, if the knitted fabric is flat, in either case of one knitted fabric and a plurality of knitted fabrics, the knitted fabric has to be deformed into a three-dimensional shape by joining together the joint portions needing each other. Hence, it is further troublesome work to perform the joining operation of joining the joint portions together while the operator deforms the flat knitted fabric into the three-dimensional shape and temporarily retains the joined state of the joint portions because the difficulty in the joining operation increases, and also the joining operation further takes time.

It is an object of the invention to provide footwear that can simplify joining operation of joining joint portions together and reduce the time of the operation by temporarily retaining a joined state of a knitted fabric by the joint portions when footwear is formed in a three-dimensional shape.

To attain the above-described object, the present invention presupposes footwear obtained by forming one or a plurality of knitted fabrics knitted with a flat knitting machine including at least a pair of front and rear needle beds into a three-dimensional shape by joining together joint portions needing each other. Further, the joint portions of the knitted fabric include a first temporary retainment portion extended by knitting from at least one of the joint portions, and a second temporary retainment portion provided by knitting at the other of the joint portions and temporarily retaining the first temporary retainment portion. At least the first temporary retainment portion of both the temporary retainment portions is firmly joined by using joining means so that a temporarily retained state in which the joint portions of the knitted fabric are temporarily retained to each other by both the temporary retainment portions becomes a firmly joined state.

Further, an insertion piece is employed as the first temporary retainment portion, and an insertion opening is employed as the second temporary retainment portion. The insertion piece has a barb that prevents the insertion piece from being released from the insertion opening when the insertion piece is inserted into the insertion opening.

Also, the insertion piece inserted into the insertion opening may be preferably located at a foot-bottom side when the joint portions of the knitted fabric are joined together.

Further, a thermal fusion yarn may be preferably employed as a knitting yarn for knitting at least the joint portions and the first and second temporary retainment portions of the knitted fabric.

Advantageous Effects of Invention

By firmly joining at least the first temporary retainment portion by using the joining means so that the temporarily retained state in which the joint portions of the knitted fabric are joined together by the first temporary retainment portion extended from at least one of the joint portions and the second temporary retainment portion that temporarily retains the first temporary retainment portion at the other of the joint portions becomes a firmly joined state, the joint portions of the knitted fabric are brought into the firmly joined state. Accordingly, the joint portions are kept in the temporarily retained state by both the temporary retainment portions until the joint portions are brought into the firmly joined state. The operator does not have to keep the temporarily retained state when joining the joint portions together, and hence the joining operation of joining the joint portions together can be simplified and the time of the operation can be reduced.

Further, since the insertion piece employed as the first temporary retainment portion has the barb that prevents the insertion piece from being released from the insertion opening employed as the second temporary retainment portion when the insertion portion is inserted into the insertion opening, the temporarily retained state of the joint portions can be smoothly kept until joining between the joined portions is completed. Accordingly, the joining operation of joining the joint portions together can be further simplified and the time of the operation can be further reduced.

Also, since the insertion piece inserted into the insertion opening is located at the foot-bottom side when the joint portions of the knitted fabric are joined together, the insertion piece can be hidden not to be apparent by joining means such as a sole member that is joined to the foot-bottom side. In addition, if the insertion piece is located at a lower surface of the knitted fabric at the foot-bottom side, the insertion piece may be firmly joined to the knitted fabric at the foot-bottom side by using joining means such as an adhesive, or may be firmly joined by a sole member that is joined to the lower surface of the knitted fabric at the foot-bottom side.

Further, since the thermal fusion yarn is employed as the knitting yarn for knitting at least the joint portions and the first and second temporary retainment portions of the knitted fabric, the first and second temporary retainment portions are molten and adhere to each other when heat is applied after the temporary retainment. This can prevent both the temporary retainment portions from being released from each other, and provide certain strength. The joint portions are smoothly kept in the temporarily retained state by the temporal retainment portions until joining by the joining means is completed.

DETAILED DESCRIPTION OF THE PREFERRED EMBODIMENTS

An embodiment of the present invention is described below on the basis of the drawings.

Figure 1:
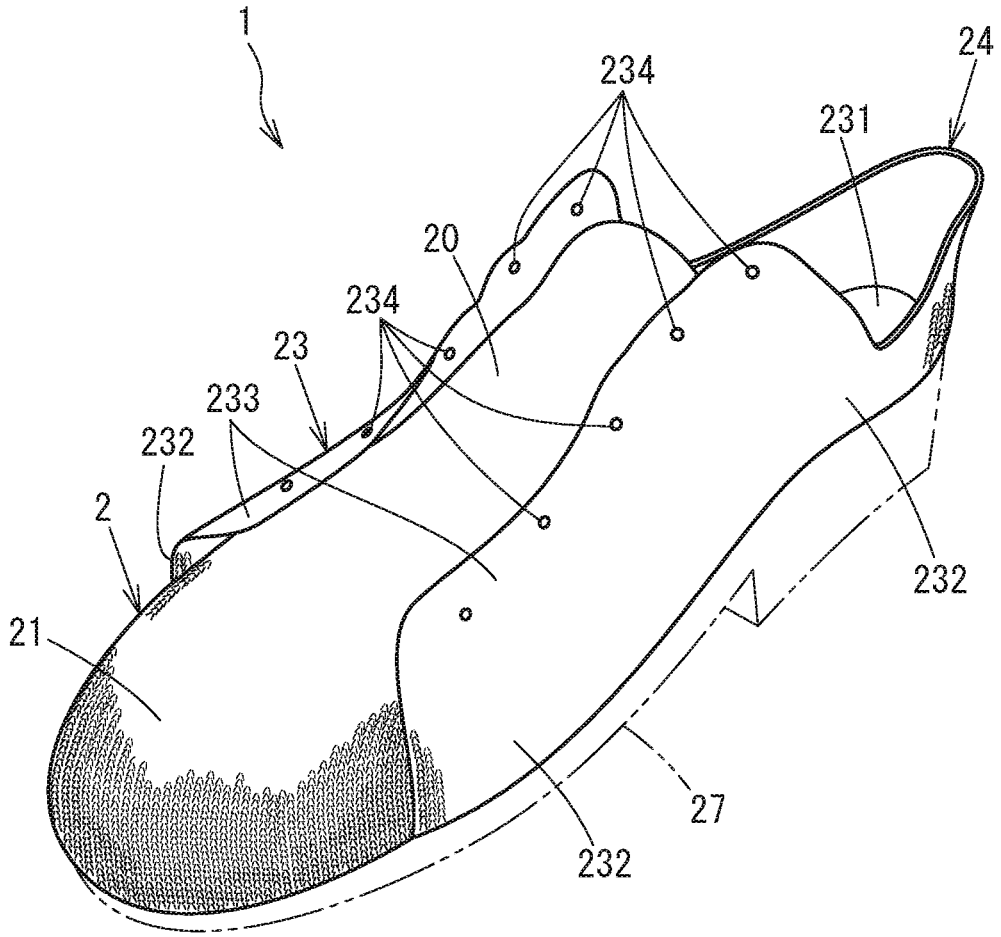
FIG. 1 is a perspective view of footwear according to an embodiment of the present invention.
Figure 2:
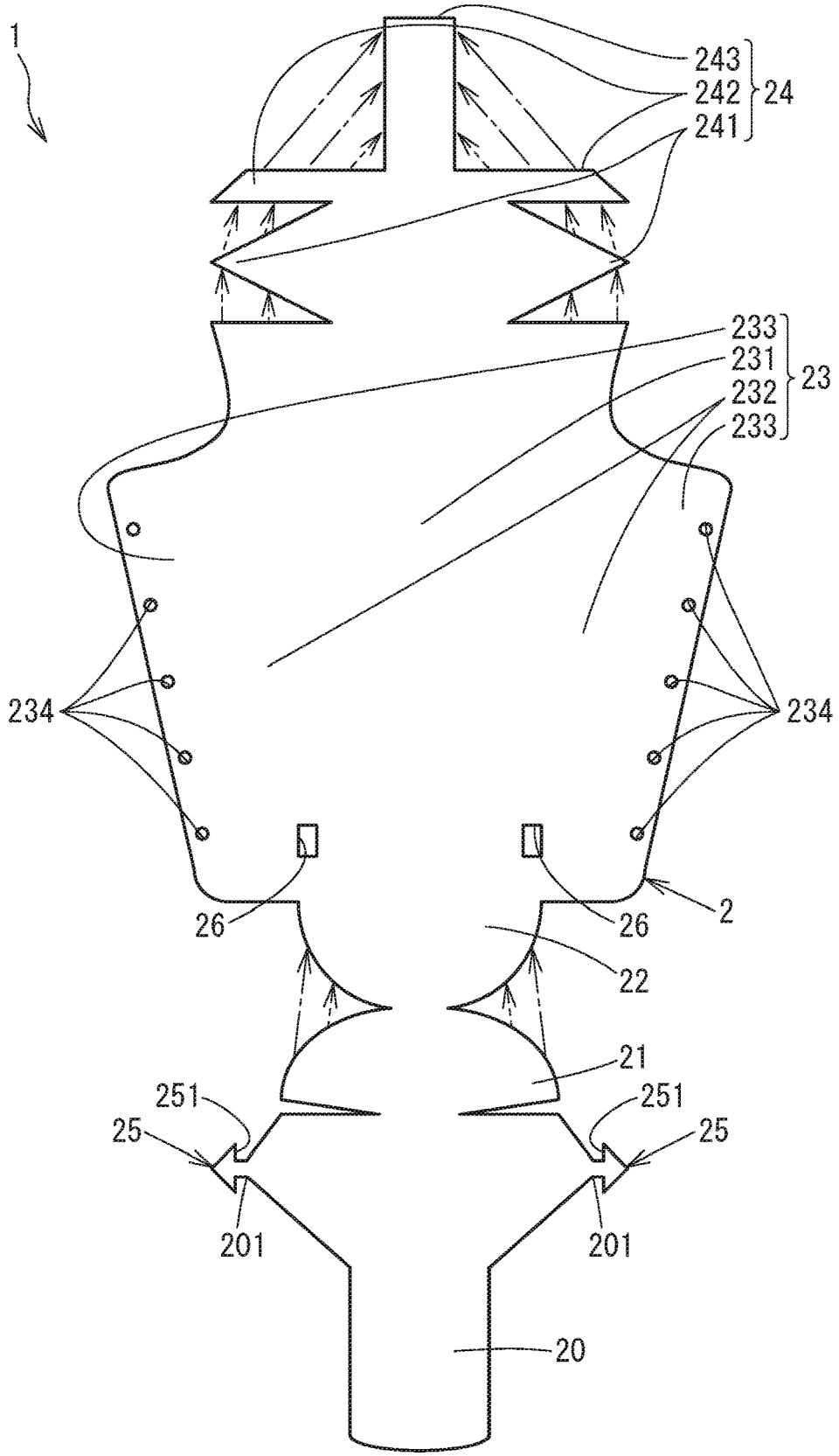
FIG. 2 is a schematic illustration illustrating a knitting procedure of the footwear in FIG. 1.

FIG. 1 is a perspective view of footwear according to the embodiment of the present invention. FIG. 2 is a schematic illustration illustrating a knitting procedure of the footwear.

In FIGS. 1 and 2, footwear 1 is formed of one knitted fabric 2 knitted with a flat knitting machine (not illustrated) including at least a pair of front and rear needle beds and being able to transfer stitches between the front and rear needle beds. The knitted fabric 2 includes a shoe tongue part 20 located at a foot-instep side, an instep-side toe part 21 continuous from a front end of the shoe tongue part 20, a bottom-side toe part 22 continuous from a front end of the instep-side toe part 21 and extending to a sole side, a main part 23 continuous from a rear end of the bottom-side toe part 22, and a heel part 24 continuous from a rear end of the main part 23, and forms the footwear 1 for outside use. The shoe tongue part 20, the instep-side toe part 21, the bottom-side toe part 22, the main part 23, and the heel part 24 are integrally knitted seamlessly. At this time, a thermal fusion yarn K is employed as a knitting yarn for knitting the knitted fabric 2.

The shoe tongue part 20 is a knitting-start end of the knitted fabric 2. Knitting is started from a tip end (rear end) of the shoe tongue part 20, and a front half section of the shoe tongue part 20 is knitted with a substantially equivalent knitting width in a left-right direction. A rear half section of the shoe tongue part 20 is provided with a pair of left and right insertion pieces 25, 25 serving as first temporary retainment portions extended outward in the left-right direction by knitting. Each insertion piece 25 is knitted at an extended end 201 serving as one of joint portions obtained by gradually increasing the knitting width in the rear half section of the shoe tongue part 20 and extending the fabric outward in the left-right direction. The insertion piece 25 has a barb 251 that prevents the insertion piece 25 from being released from the insertion opening 26 when the insertion piece 25 is inserted into the insertion opening 26. Knitting of the insertion piece 25 having the barb 251 will be described later. While the shoe tongue part 20 serves as the knitting-start end of the knitted fabric 2, knitting may be started from a heel side if the shape of the heel part 24 is partly changed to, for example, an inverted trapezoidal shape.

The knitting width of the shoe tongue part 20 is gradually decreased in a portion corresponding to the extended end 201 and its downstream side of the rear half section of the shoe tongue part 20, thus the extension of the fabric is converged inward in the left-right direction, and knitting of the part is ended with a center portion thereof left.

The instep-side toe part 21 is knitted such that the knitting width thereof is increased stepwise from the center portion at the front end of the shoe tongue part 20 (base end of rear half section) until the knitting width satisfies the width of the toe part. The instep-side toe part 21 is knitted into an arc-like toe shape while the knitting width is gradually decreased from when the knitting width satisfies the width of the toe part with only a center portion thereof left. The bottom-side toe part 22 is knitted into an arc-like toe shape while the knitting width is gradually increased from the center portion at the front end (base end) of the instep-side toe part 21. The arc-like shape of the bottom-side toe part 22 is connected to the arc-like toe shape of the instep-side toe part 21 at the front end thereof.

The main part 23 is knitted from the rear end (base end) of the bottom-side toe part 22. The main part 23 is knitted such that the knitting width is increased in the left-right direction while the number of stitches is increased with reference to a sole 231 in a center portion in the left-right direction, continuously from both side portions 232 at left and right sides of the sole 231 to left and right instep covering portions 233. At this time, five holes 234 for shoelaces are provided at each of the left and right instep covering portions 233 of the main part 23. The five holes 234 are evenly spaced apart in a front-rear direction. In this case, each hole 234 for shoelace is knitted by a conventionally known knitting method, for example, with a mesh using transferring.

Also, the knitting width of the main part 23 in a portion corresponding to the instep covering portion 233 and its downstream side is gradually decreased in an area below the ankle while the number of stitches is decreased up to the knitting width between the both side portions 232, and hence the both side portions 232 without the instep covering portions 233 are knitted.

The heel part 24 includes left and right first heel pieces 241 continuous from the rear end of the main part 23 (rear end of sole 231), left and right second heel pieces 242 continuous from rear ends of the first heel pieces 241, and a single third heel piece 243 continuous from rear ends of the second heel pieces 242. The first heel pieces 241 are knitted such that the fabric is extended outward in the left-right direction by gradually increasing the knitting width from a center portion at the rear end of the main part 23, the knitting width is gradually decreased when the knitting width is extended up to a knitting width substantially equivalent to the knitting width between the both side portions 232, and the fabric is converged inward in the left-right direction. Also, the second heel pieces 242 are knitted in strip-like shapes being long in the left-right direction with a knitted width substantially equivalent to the knitting width between the both side portions 232 from the rear ends of the first heel pieces 241. Further, the third heel piece 243 is knitted in a strip-like shape being long rearward with a knitted width slightly smaller than a half of the knitting width between the both side portions 232 from a center portion at the rear ends of the second heel pieces 242.

At this time, front ends of the first heel pieces 241 are connected to rear ends of the both side portions 232 of the main part 23 when the first heel pieces 241 are knitted while the knitting width thereof is gradually increased from the rear end of the main part 23. Also, front ends of the second heel pieces 242 are connected to the rear ends of the first heel pieces 241 when the second heel pieces 242 are knitted into the strip-like shapes being long in the left-right direction from the rear ends of the first heel pieces 241. Also, both left and right ends of the third heel piece 243 are connected to the rear ends of the second heel pieces 242 when the third heel piece 243 is knitted into the strip-like shape being long rearward from the center portion at the rear ends of the second heel pieces 242.

Figure 3A:
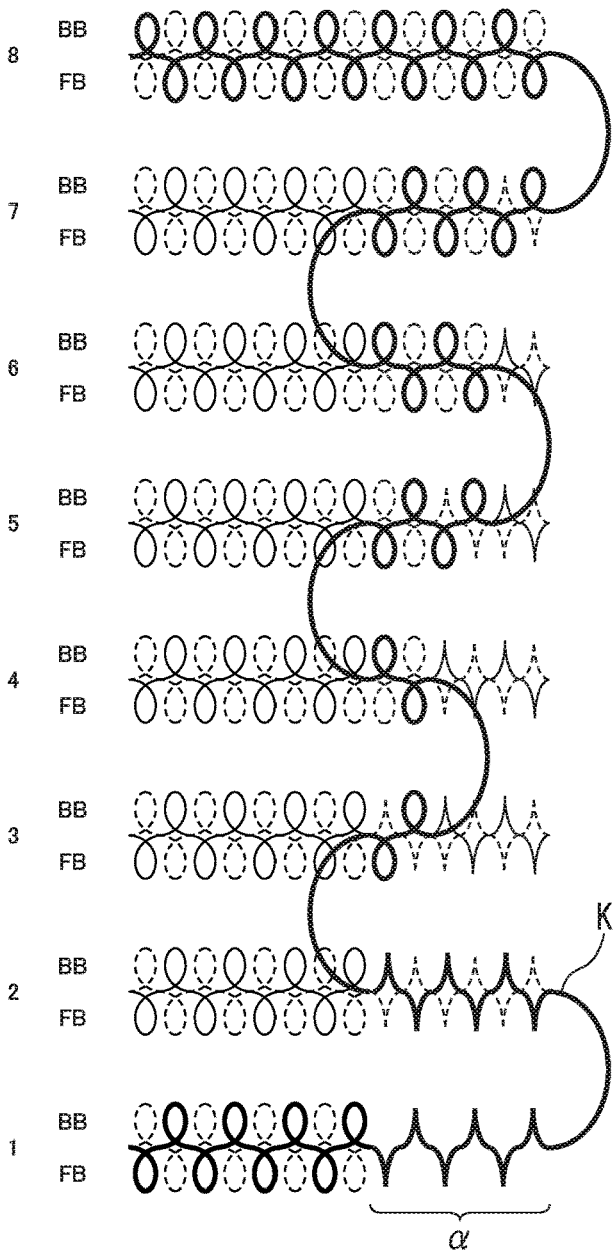
FIGS. 3A and 3B provide explanatory views explaining a knitting process of an insertion piece of the footwear in FIG. 1, FIG. 3A illustrating a knitting diagram of a half of the insertion piece, FIG. 3B schematically illustrating a forming diagram of the insertion piece in accordance with the knitting diagram.
Figure 3B:
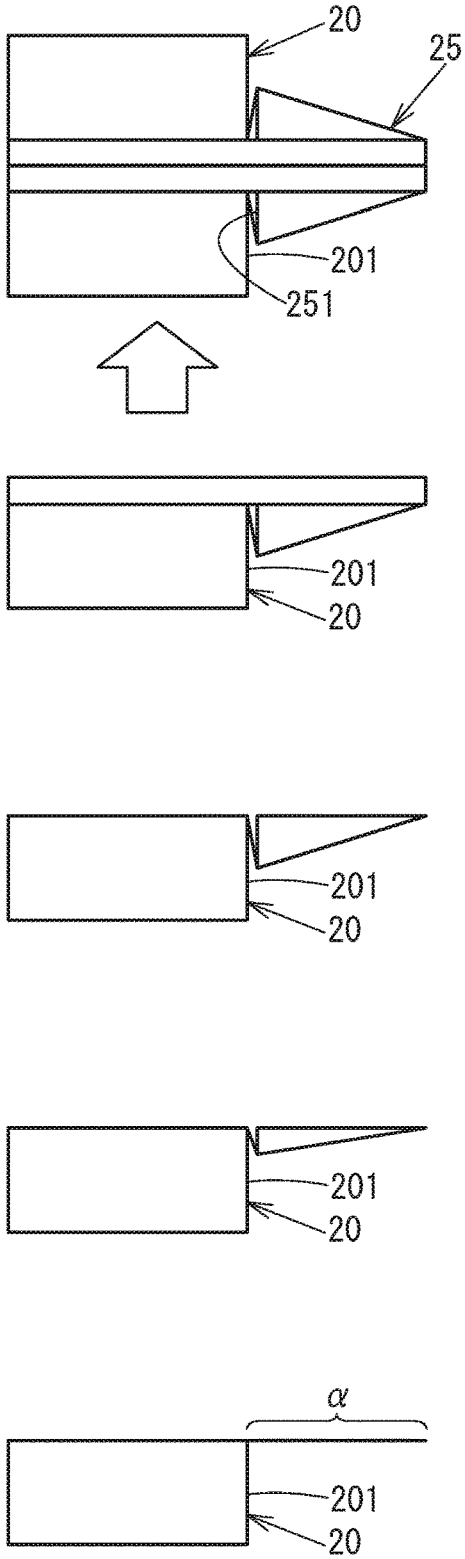

FIGS. 3A and 3B provide explanatory views explaining a knitting process of the insertion piece 25 of the footwear 1, FIG. 3A illustrating a knitting diagram of a half of the insertion piece 25, FIG. 3B schematically illustrating a forming diagram of the insertion piece 25.

In S1 of FIG. 3A, the thermal fusion yarn K from a yarn supply port (not illustrated) is knitted rightward in the drawing by alternately using knitting needles of the front needle bed FB and the rear needle bed BB in a staggered manner. The thermal fusion yarn K is knitted up to a tip end of the extended end 201 at which the fabric is extended in the rear half section of the shoe tongue part 20 of the knitted fabric 2. Then the thermal fusion yarn K forms pick up stitches rightward in the drawing in a staggered manner alternately at the front and rear needle beds. In S2, pick up stitches are formed leftward in the drawing in a staggered manner alternately at knitting needles at which pick up stitches have not been formed in S1. Thus a knitting start $\alpha$ of the insertion piece 25 is formed as illustrated in FIG. 3B.

In S3 and S4, new stitches continuous from the pick up stitches engaged at the knitting needles are formed by partial knitting. In this case, knitting of the insertion piece 25 by double-sided knitting is illustrated.

In S5 to S7, partial knitting is performed while the knitting width of the insertion piece 25 is gradually increased. Thus a fabric having a substantially triangular shape serving as the barb 251 is formed.

In S8, when partial knitting is performed until the knitting width of a first half portion of the insertion piece 25 is achieved, a first half portion of the barb 251 of the insertion piece 25 is connected continuously from knitting up to the tip end of the extended end 201 of the rear half section of the shoe tongue part 20 while knitting returns from the tip end. At this time, it may be difficult to perform knitting because of generation of a cross-over yarn from the extended end 201 to the barb 251. Therefore, a yarn may be supplied from a new yarn supply port and may knit the insertion piece 25 instead of the yarn supply port from which the thermal fusion yarn K which had been used for knitting up to the tip end of the extended end 201 of the rear half section of the shoe tongue part 20.

Alternatively, the thermal fusion yarn K which had been used for knitting up to the tip end of the extended end 201 of the rear half section of the shoe tongue part 20 may be cut once, and then knitting of the insertion piece 25 may be started with the thermal fusion yarn K.

Thereafter, a second half portion of the barb 251 of the insertion piece 25 is knitted in an inverse procedure. By finally performing binding off, knitting of the whole portion of the insertion piece 25 is completed.

Alternatively, the insertion piece 25 may be knitted from the tip end toward the extended end 201 side. In this case, the knitting width is gradually increased from the tip end of the insertion piece 25, binding off may be performed at portions of barbs on both sides, and stitches in a center portion may be connected to stitches in an end portion of each knitting course of the extended end 201 in a sequentially overlapped manner.

Also, a pair of left and right insertion openings 26, 26 are provided in the front end portion of the main part 23. The insertion openings 26 serve as second temporary retainment portions that receive the insertion pieces 25 inserted thereinto at positions substantially the same as the position of the rear end of the bottom-side toe part 22 along the knitting width, and that temporarily retain the insertion pieces 25. Each insertion opening 26 linearly extends toward the heel part 24 side, and is knitted by a conventionally known knitting method for a slit.

Figure 4A:
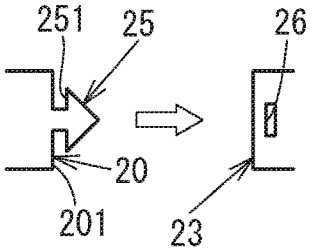
FIGS. 4A and 4B provide explanatory views schematically explaining a process of temporarily retaining insertion pieces at left and right extended ends of a shoe tongue part, at both left and right positions of a sole in a front end portion of a main part in a knitted fabric of the footwear in FIG. 2, FIG. 4A illustrating a state before an insertion piece is inserted into an insertion opening, FIG. 4B illustrating a state after the insertion piece is inserted into the insertion opening.
Figure 4B:
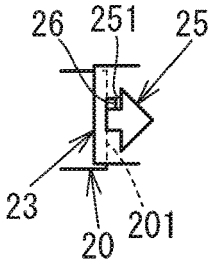

FIGS. 4A and 4B provide explanatory views schematically explaining a process of temporarily retaining the insertion pieces 25 at the left and right extended ends 201 of the shoe tongue part 20, at both left and right positions of the sole 231 in the front end portion of the main part 23 in the knitted fabric 2 of the footwear 1, FIG. 4A illustrating a state before each insertion piece 25 is inserted into the corresponding insertion opening 26, FIG. 4B illustrating a state after the insertion piece 25 is inserted into the insertion opening 26. The insertion pieces 25 of the extended ends 201 in which the fabric is extended outward in the left-right direction from the rear half section of the shoe tongue part 20 are inserted into the insertion openings 26 linearly extending toward the heel part 24 side at both the left and right positions (the other of joint portions) of the sole 231 in the front end portion of the main part 23. The barbs 251 prevent the insertion pieces 25 from being released from the insertion openings 26 when the insertion pieces 25 are inserted into the insertion openings 26. At this time, the left and right extended ends 201 of the shoe tongue part 20 and both the left and right positions in the front end portion of the main part 23 are smoothly temporarily retained by the barbs 251 of the insertion pieces 25 inserted into the insertion openings 26.

Also, the insertion pieces 25 inserted into the insertion openings 26 are temporarily retained at a lower surface of the sole 231 of the main part 23. The insertion pieces 25 located at the lower surface of the sole 231 of the main part 23 are firmly joined by using an outer sole 27 that is made of resin etc. and that serves as joining means to be joined to the lower surface of the sole 231 of the main part 23. The temporarily retained state in which the left and right extended ends 201 of the shoe tongue part 20 and both the left and right positions of the sole 231 in the front end section of the main part 23 are temporarily retained to each other becomes the firmly joined state. Accordingly, the temporarily retained state between the left and right extended ends 201 of the shoe tongue part 20 and both the left and right positions of the sole 231 in the front end portion of the main part 23 is kept by the insertion pieces 25 which are inserted into the insertion openings in the temporarily retained state until the firmly joined state is attained therebetween. An operator does not have to keep the temporarily retained state when the operator joins the left and right extended ends 201 of the shoe tongue part 20 to both the left and right positions of the sole 231 in the front end portion of the main part 23. The joining operation of joining both can be simplified and the time of the operation can be reduced. In addition, since the insertion pieces 25 are located at the lower surface of the sole 231 of the main part 23, the insertion piece 25 can be hidden not to be apparent when the insertion pieces 25 are joined by using the outer sole 27.

Also, since the knitted fabric 2 is knitted with the thermal fusion yarn K, the insertion pieces 25 are molten and adhere to the lower surface of the sole 231 of the main part 23 when heat is applied. This may prevent the insertion pieces 25 from being released from the insertion openings 26 and provide certain strength. The insertion pieces 25 and the insertion openings 26 smoothly keep the temporarily retained state between the left and right extended ends 201 of the shoe tongue part 20 and both the left and right positions of the sole 231 in the front end portion of the main part 23, until joining with the outer sole 27 is completed. Accordingly, the joining operation of joining the left and right extended ends 201 of the shoe tongue part 20 to both the left and right positions of the sole 231 in the front end portion of the main part 23 can be further simplified and the time of the joining operation can be further reduced.

Figure 5:
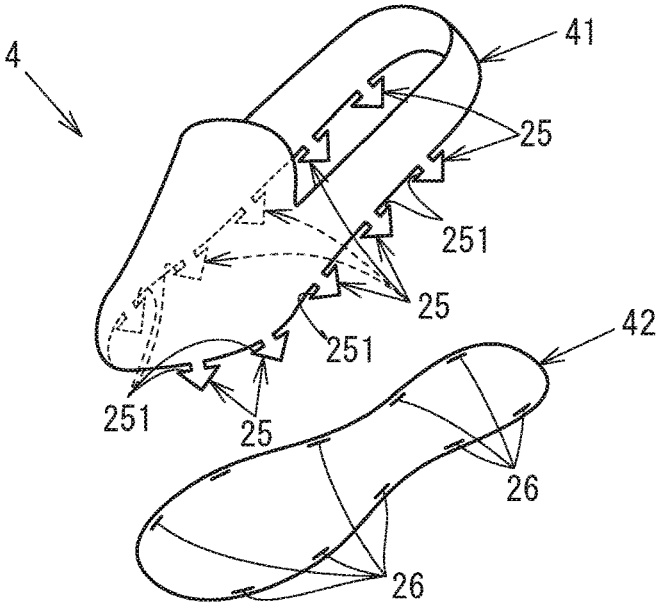
FIG. 5 is a perspective view illustrating a state before two knitted fabrics of footwear according to a modification of the embodiment are temporarily retained by insertion pieces that are inserted into insertion openings.
Figure 6:
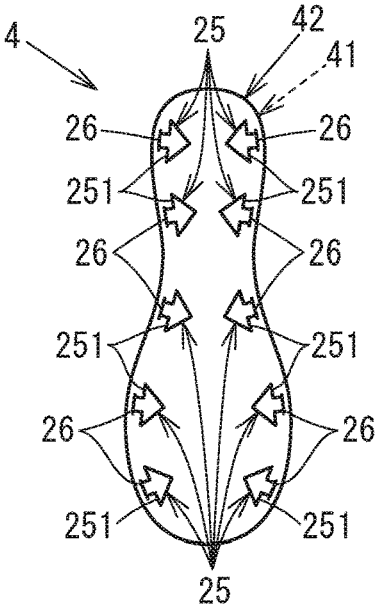
FIG. 6 is a bottom view when the knitted fabric at the foot-bottom side is viewed from below in a state in which the two knitted fabrics of the footwear in FIG. 5 are temporarily retained by the insertion pieces inserted into the insertion openings.

While the footwear 1 is formed of the one knitted fabric 2 in the above-described embodiment, an upper-side knitted fabric 41 (knitted fabric) covering a portion at the foot-top (instep) side may be knitted by using, for example, a knitting method as described in WO2015/037540A1, and a footwear 4 may be formed of that upper-side knitted fabric 41 and an under-side knitted fabric 42 (knitted fabric) covering the foot-bottom side as illustrated in FIGS. 5 and 6. Extended insertion pieces 25 are provided at ten positions evenly spaced apart from one another at a lower edge of the upper-side knitted fabric 41. In contrast, insertion openings 26 are provided at ten positions evenly spaced apart from one another at a peripheral edge of the under-side knitted fabric 42. The insertion openings 26 extend linearly along the peripheral edge. Each insertion piece 25 has a barb 251, is inserted into the corresponding insertion opening 26, and is located at the lower surface of the under-side knitted fabric 42. Accordingly, the insertion pieces 25 can be firmly joined by using an outer sole 27 that is joined to the lower surface of the under-side knitted fabric 42 so that the temporarily retained state between the lower edge of the upper-side knitted fabric 41 and the peripheral edge of the under-side knitted fabric 42 obtained by the insertion pieces 25 inserted into the insertion openings 26 becomes the firmly joined state.

Also, in the above-described embodiment, the temporarily retained state in which the insertion pieces 25 of the left and right extended ends 201 of the shoe tongue part 20 of the knitted fabric 2 of the footwear 1 are temporarily retained at both the left and right positions of the sole 231 in the front end portion of the main part 23 becomes the firmly joined state by using the outer sole 27. However, insertion pieces may be firmly joined to a lower surface of a sole of a main part so that the temporarily retained state in which the insertion pieces are temporarily retained at the sole of the main part becomes the firmly joined state by applying an adhesive as joining means to the insertion pieces.

At this time, when the footwear is completed by joining with the insertion pieces using the adhesive, the shapes of the insertion pieces inserted into the insertion openings may have circular shapes, rectangular shapes, or cut-piece shapes so as to collaboratively define the foot-bottom shape. The number of the insertion pieces is not particularly limited.

When such insertion pieces are knitted, the insertion pieces may be knitted by garter stitch, back stitch, etc. The insertion pieces may also have a non-slip function by adding a raw rubber yarn to the knitting yarn.

In the modification of the above-described embodiment, the insertion pieces 25 are extended from the lower edge of the upper-side knitted fabric 41, and the insertion openings 26 are provided to linearly extend along the peripheral edge of the under-side knitted fabric 42. However, insertion openings may be provided to linearly extend along a lower edge of an upper-side knitted fabric, and insertion pieces may be extended from a peripheral edge of an under-side knitted fabric.

In this case, if the insertion pieces inserted into the insertion openings are located at an upper surface of the under-side knitted fabric, the insertion pieces may be firmly joined by using a sole cover serving as joining means that is joined to the upper surface of the under-side knitted fabric. In contrast, if the insertion pieces inserted into the insertion openings stand along an inner surface of the upper-side knitted fabric, the insertion pieces may be firmly joined by using an inner cover serving as joining means that is joined to the inner surface of the upper-side knitted fabric.

Also, in the above-described embodiment, the left and right extended ends 201 of the shoe tongue part 20 and both the left and right positions of the sole 231 in the front end portion of the main part 23 are temporarily retained by inserting the insertion pieces 25 into the insertion openings 26. However, joint portions of a knitted fabric may be temporarily retained by tying first and second retainment portions extended from both the joint portions together.

Further, in the above-described embodiment, the thermal fusion yarn K is employed as the knitting yarn for knitting the knitted fabric 2. However, at least part of the knitted fabric, such as left and right extended ends of a shoe tongue part, both left and right positions of a sole in a front end portion of a main part, insertion pieces, and insertion openings, may be knitted with a thermal fusion yarn.

REFERENCE SIGNS LIST

1 footwear

2 knitted fabric

201 left and right extended ends of shoe tongue part (joint portions)

232 both left and right positions of sole in front end portion of main part (joint portions)

25 insertion piece (first temporary retainment portion)

251 barb

26 insertion opening (second temporary retainment portion)

27 outer sole (joining means)

4 footwear

41 upper-side knitted fabric (knitted fabric)
42 under-side knitted fabric (knitted fabric)
K thermal fusion yarn

What is claimed is:

1. Footwear obtained by forming one knitted fabric knitted with a flat knitting machine including at least a pair of front and rear needle beds into a three-dimensional shape by joining together joint portions of a knitted fabric, wherein the knitted fabric includes a shoe tongue part located at a foot-instep side, an instep-side toe part continuous from a front end of the shoe tongue part, a bottom-side toe part continuous from a front end of the instep-side toe part and extending to a sole side, a main part continuous from a rear end of the bottom-side toe part, the main part comprising a sole and both side portions at left and right sides of the sole, and a heel part continuous from a rear end of the main part, wherein the joint portions of the knitted fabric include a first temporary retainment portion extended by knitting from the shoe tongue part, and a second temporary retainment portion provided by knitting at the main part and temporarily retaining the first temporary retainment portion, wherein the the first temporary retainment portion is firmly joined by using joining means so that a temporarily retained state in which the joint portions of the knitted fabric are temporarily retained to each other by the temporary retainment portions becomes a firmly joined state, wherein an insertion piece is employed as the first temporary retainment portion, and an insertion opening is employed as the second temporary retainment portion, and wherein the insertion piece has a barb that prevents the insertion piece from being released from the insertion opening when the insertion piece is inserted into the insertion opening.

2. The footwear according to claim 1, wherein the insertion piece inserted into the insertion opening is located at a foot-bottom side when the joint portions of the knitted fabric are joined together.

3. The footwear according to claim 1, wherein a thermal fusion yarn is employed as a knitting yarn for knitting at least the joint portions and the first and second temporary retainment portions of the knitted fabric.

4. The footwear according to claim 2, wherein a thermal fusion yarn is employed as a knitting yarn for knitting at least the joint portions and the first and second temporary retainment portions of the knitted fabric.

* * * * *